US010450845B2

(12) United States Patent
Wubben et al.

(10) Patent No.: US 10,450,845 B2
(45) Date of Patent: Oct. 22, 2019

(54) EXPANDING A TUBULAR ELEMENT IN A WELLBORE

(71) Applicant: SHELL OIL COMPANY, Houston, TX (US)

(72) Inventors: Antonius Leonardus Maria Wubben, Rijswijk (NL); Tino Walter Van Der Zee, Joure (NL); Remmelt Bouma, Joure (NL); Erik Van Dalfsen, Joure (NL)

(73) Assignee: SHELL OIL COMPANY, Houston, TX (US)

( * ) Notice: Subject to any disclaimer, the term of this patent is extended or adjusted under 35 U.S.C. 154(b) by 253 days.

(21) Appl. No.: 15/529,409

(22) PCT Filed: Dec. 9, 2015

(86) PCT No.: PCT/EP2015/079159
§ 371 (c)(1),
(2) Date: May 24, 2017

(87) PCT Pub. No.: WO2016/091970
PCT Pub. Date: Jun. 16, 2016

(65) Prior Publication Data

US 2017/0328185 A1 Nov. 16, 2017

(30) Foreign Application Priority Data

Dec. 12, 2014 (EP) ..... 14197545

(51) Int. Cl.
*E21B 43/10* (2006.01)
*E21B 23/01* (2006.01)

(52) U.S. Cl.
CPC ..... *E21B 43/105* (2013.01); *E21B 23/01* (2013.01); *E21B 43/103* (2013.01)

(58) Field of Classification Search
CPC ..... E21B 43/105
See application file for complete search history.

(56) References Cited

U.S. PATENT DOCUMENTS 7,131,498 B2 11/2006 Campo
7,467,671 B2 12/2008 Savignat et al.
(Continued)

FOREIGN PATENT DOCUMENTS

EP 1044316 A1 10/2000
WO 9741377 A1 11/1997
(Continued)

OTHER PUBLICATIONS

International Search Report and Written Opinion received for PCT Patent Application No. PCT/EP2015/079155, dated Feb. 15, 2016, 10 pages.
(Continued)

*Primary Examiner* — D. Andrews

(57) ABSTRACT

A system for radially expanding a tubular element (2) in an underground borehole (3) comprises an expansion string (16) extending into the tubular element (2) and including an expander (27) and a jack device (24) for pulling the expander (27) through the tubular element (2) so as to radially expand the tubular element (2). The jack device (24) is provided with an anchor (28) having at least one slip element (50) adapted to be radially moved against the inner surface of the tubular element (2). A cage (14) is positioned above the tubular element (2), which cage (14) is surrounded by a cylindrical wall and adapted to receive the anchor (28) and to be radially expanded by the anchor (28) against said cylindrical wall.

15 Claims, 5 Drawing Sheets

(56) References Cited

U.S. PATENT DOCUMENTS

| | | | | |
|---|---|---|---|---|
| 2005/0161226 | A1* | 7/2005 | Duggan | E21B 43/103 166/380 |
| 2005/0217866 | A1* | 10/2005 | Watson | E21B 43/103 166/384 |
| 2005/0279509 | A1 | 12/2005 | Benzie et al. | |
| 2006/0065403 | A1 | 3/2006 | Watson et al. | |
| 2006/0196654 | A1 | 9/2006 | Benzie et al. | |
| 2007/0000669 | A1 | 1/2007 | McKee et al. | |
| 2008/0041596 | A1 | 2/2008 | Blount et al. | |
| 2009/0242213 | A1 | 10/2009 | Braddick | |
| 2010/0257913 | A1 | 10/2010 | Storm, Jr. et al. | |
| 2013/0312954 | A1 | 11/2013 | Di Crescenzo et al. | |
| 2017/0130536 | A1 | 5/2017 | Stam et al. | |
| 2017/0145778 | A1 | 5/2017 | Zijsling et al. | |
| 2017/0145797 | A1 | 5/2017 | Stam et al. | |

FOREIGN PATENT DOCUMENTS

| | | | |
|---|---|---|---|
| WO | 2012104257 | A1 | 8/2012 |
| WO | 2014044630 | A1 | 3/2014 |

OTHER PUBLICATIONS

U.S. Appl. No. 15/503,086, "Assembly and Method for Creating an Expanded Tubular Element in a Borehole", filed Feb. 10, 2017.

International Search Report and Written Opinion received for PCT Patent Application No. PCT/EP2015/079159, dated Feb. 15, 2016, 9 pages.

* cited by examiner

EXPANDING A TUBULAR ELEMENT IN A WELLBORE

CROSS REFERENCE TO EARLIER APPLICATION

This application is a US national stage application of PCT/EP2015/079159, filed 9 Dec. 2015, which claims priority benefits of European Application No. 14197545.8, filed 12 Dec. 2014.

FIELD OF THE INVENTION

The present invention relates to a system for radially expanding a tubular element in a borehole formed in an earth formation.

BACKGROUND

Wellbores for the production of hydrocarbon fluid generally are provided with steel casings and/or liners to provide stability to the wellbore wall and to prevent undesired flow of fluid between the wellbore and the surrounding earth formation. A casing generally extends from surface into the wellbore, whereas a liner may extend only a lower portion of the wellbore. However in the present description the terms "casing" and "liner" are used interchangeably and without such intended difference.

In a conventional wellbore, the wellbore is drilled in sections whereby each section is drilled using a drill string that has to be lowered into the wellbore through a previously installed casing. In view thereof the wellbore and the subsequent casing sections decrease in diameter with depth. The production zone of the wellbore therefore has a relatively small diameter in comparison to the upper portion of the wellbore. In view thereof it has been proposed to drill a "mono diameter" wellbore whereby the casing or liner to be installed is radially expanded in the wellbore after lowering to the required depth. Subsequent wellbore sections may therefore be drilled at a diameter larger than in the conventional wellbore. If each casing section is expanded to the same diameter as the previous section, the wellbore diameter may remain substantially constant with depth.

U.S. 2010/0257013 A1 discloses a system including an expansion device for radially expanding and plastically deforming a tubular element whereby an actuator is coupled to the expansion device and whereby an anchor is coupled to the actuator. The anchor is activated to anchor the actuator to the tubular element while the actuator strokes in to expand a section of the tubular element. Thereafter the anchor is deactivated and pulled upward in order to allow starting expansion of a next section of the tubular element.

It is a drawback of the known system that, after arrival of the anchor at the top of the tubular element, a final upper portion of the tubular element cannot be expanded in this manner since the anchor no longer can be anchored to the tubular element at a higher position.

SUMMARY OF THE INVENTION

The invention provides a system for radially expanding a tubular element in a borehole formed in an earth formation, the system comprising:

an expansion string extending into the tubular element and including an expander and a jack device for pulling the expander through the tubular element so as to radially expand the tubular element;

the jack device being provided with an anchor having at least one slip element adapted to be radially moved against the inner surface of the tubular element; and a cage positioned above the tubular element and being surrounded by a cylindrical wall, the cage being adapted to receive the anchor and to be radially expanded by the anchor against said cylindrical wall.

The invention also provides a method of radially expanding a tubular element in a borehole formed in an earth formation, the method comprising:

extending an expansion string into the tubular element, the expansion string including an expander and a jack device provided with an anchor having at least one slip element adapted to be radially moved against the inner surface of the tubular element;

positioning a cage above the tubular element, the cage being surrounded by a cylindrical wall;

receiving the anchor in the cage and inducing the anchor to radially expanded the cage against said cylindrical wall; and pulling the expander through the tubular element using the jack device so as to radially expand the tubular element.

BRIEF DESCRIPTION OF THE DRAWINGS

The invention will be described hereinafter by way of example in more detail with reference to the accompanying drawings in which.

In the detailed description and the drawings, like reference numerals relate to like components.

DETAILED DESCRIPTION

Figure 1:
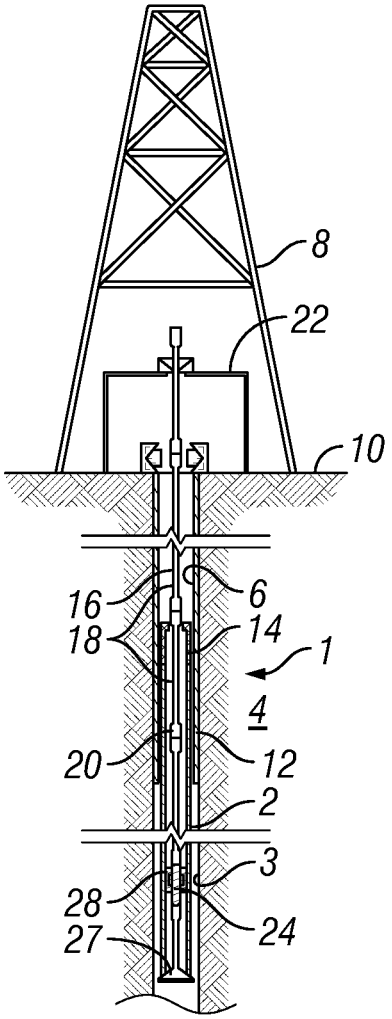
FIG. 1 schematically shows an embodiment of the system of the invention at the onset of expansion of the tubular element.

A method of radially expanding a tubular element in a borehole formed in an earth formation is proposed, wherein:

extending an expansion string into the tubular element, the expansion string including an expander and a jack device provided with an anchor having at least one slip element adapted to be radially moved against the inner surface of the tubular element;

positioning a cage above the tubular element, the cage being surrounded by a cylindrical wall;

receiving the anchor in the cage and inducing the anchor to radially expanded the cage against said cylindrical wall; and pulling the expander through the tubular element using the jack device so as to radially expand the tubular element.

Upon arrival of the anchor at the top of the tubular element, the anchor is received into the cage. Subsequently the anchor radially expands the cage against the cylindrical wall. With the anchor anchored to the cylindrical wall above the top of the tubular element by means of the cage, the final upper end portion of the tubular element may be expanded using the jack device and the expander.

Suitably the cage comprises, for each slip element, a respective slip extension member arranged to be moved by the slip element in radially outward direction against the cylindrical wall. The cage may comprises first and second ring members mutually spaced in axial direction, the ring members being interconnected by axially extending strips, and wherein each slip extension member is arranged between a respective pair of adjacent strips.

To promote receiving of the anchor in the cage, suitably each strip has a lower end portion tapering in downward direction. Also, each slip element may have an upper end portion tapering in upward direction.

The expansion string may include a mandrel interconnecting the expander and the jack device. To further promote receiving of the anchor in the cage, each slip element may be rotatable about a central longitudinal axis of the mandrel and relative to the mandrel.

Advantageously each slip extension member is locked in a radially inward position and arranged to be unlocked from the radially inward position by radially outward movement of the respective slip element against the slip extension member.

The slip extension member may be locked in the radially inward position by at least one shear pin adapted to be sheared-off by said radially outward movement of the respective slip element against the slip extension member.

To allow the cage to be moved upwardly together with the anchor, suitably the cage is connected to the upper end of the tubular element and adapted to be disconnected from said upper end by upward movement of the anchor against the cage. For example, the cage may be connected to the upper end of the tubular element by at least one shear pin adapted to be sheared-off by said upward movement of the anchor against the cage.

In one embodiment the jack device is a hydraulic jack device arranged to be operated by hydraulic fluid supplied via a fluid channel formed in the expansion string. Suitably the anchor is arranged to be moved from the radially retracted mode to the radially expanded mode by fluid pressure in the fluid channel.

The cylindrical wall may be, for example, one of the borehole wall and the wall of another tubular element extending in the borehole.

A system for radially expanding a tubular element in a borehole formed in an earth formation is also disclosed.

FIGS. 1-4 show a system 1 for expanding a tubular element 2 in a borehole 3 formed in an earth formation 4. The borehole 3 may be a wellbore for the production of hydrocarbon fluid. An expandable casing 6 extends from a drilling rig 8 at surface 10 into the borehole 3 whereby the lower end of the casing is positioned at an intermediate depth of the borehole 3. The tubular element 2 is arranged in a deeper section of the borehole 3 whereby an upper end part of the tubular element 2 extends into a lower end part of the casing 6 to form a short overlap section 12. A cylindrical cage 14 is temporarily connected to the top of the tubular element 2, as will be referred to hereinafter.

Figure 5A:
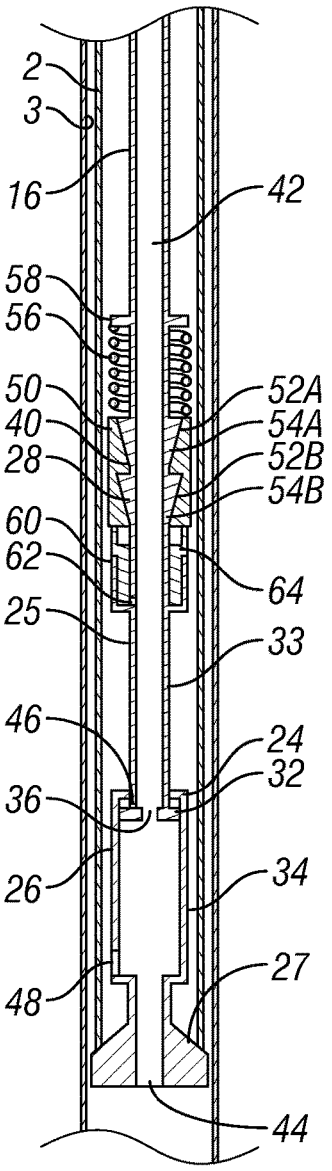
FIGS. 5A to 5E schematically show some components of the expansion string of the embodiment during various stages of the expansion process.

An expansion string 16 formed of drill pipe sections 18 interconnected by pipe connectors 20, extends from a rig floor 22 on the drilling rig 8 into the casing 6 and further into the tubular element 2. The expansion string 16 includes a hydraulic jack device 24 with telescoping upper and lower members 25, 26 (FIG. 5A). The telescoping lower member 26 is connected to an expander 27 for radially expanding the tubular element 2. The expander 27 is initially positioned just below the lower end of the tubular element 2. The telescoping upper member 25 is provided with an anchor 28 for anchoring the jack device 24 to the tubular element 2 so as to allow the jack device 24 to pull the expander 27 through the tubular element 2. At the onset of the expansion process the jack device 24 is stroked out.

FIGS. 5A to 5E show the jack device 24 and the anchor 28 in more detail, during various stages of operation. The jack device 24 is formed as a piston/cylinder assembly whereby telescoping upper member 25 includes a piston 32 and a mandrel 33. Telescoping lower member 26 includes a cylinder 34 into which the piston 32 is arranged. The piston 32 is provided with a through bore 36 adapted to be closed by a plug 38 (FIGS. 5B to 5E). The mandrel 33 is connected to, or integrally formed with, a central body 40 of the anchor 28. A fluid channel 42 extends through the telescoping upper member 30, the central body 40 and the drill pipe sections 18 to a hydraulic control system (not shown) at surface. The expander 27 is provided with a flow passage 44 that provides fluid communication between the cylinder 34 and the borehole 3 below the expander. The mandrel 33 is provided with a side opening 46 to allow hydraulic fluid to be pumped from the fluid channel 42 into the cylinder 34. Further, the cylinder 34 has a side opening 48 for venting fluid from, or drawing fluid into, the cylinder while the piston 32 moves through the cylinder.

The anchor 28 comprises a plurality of slip elements 50 circumferentially spaced around the central body 40 of the anchor. Each slip element 50 has tapering inner surfaces 52*a*, 52*b* that are in contact with respective tapering outer surfaces 54*a*, 54*b* of the central body 40. The inner and outer surfaces 52*a*, 52*b*, 54*a*, 54*b* have identical taper angles. Furthermore, each slip element 50 is arranged to slide in axial direction along the tapering outer surfaces 54*a*, 54*b* of the central body 40. Due to the taper angles of the surfaces, the slip element 50 is in a radially retracted mode when at a lower position relative to the central body 40, and in a radially expanded mode when at an upper position relative to the central body 40. In the radially expanded mode the slip element 50 contacts the inner surface of the tubular element 2. The anchor 28 is provided with a compression spring 56 arranged between the slip elements 50 and a flange 58 provided to the central body 40. The spring 56 pushes the slip elements 50 to the radially retracted mode. Furthermore, the anchor 28 is provided with a hydraulic actuator 60 in fluid communication with the fluid channel 42 via a side opening 62 in the central body 40. The hydraulic actuator includes an actuator member 64 that is movable in axial direction relative to the central body 40 and is operable by fluid pressure supplied via the fluid channel 42 so as to move the slip elements 50 against the force of the spring 56 to the radially expanded mode.

Figure 6A:
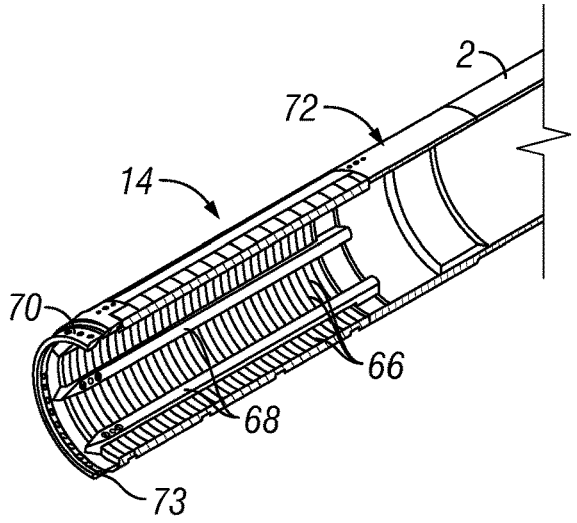
FIGS. 6A, 6B schematically show the cage used in the embodiment, seen in longitudinal section and perspective view.
Figure 6B:
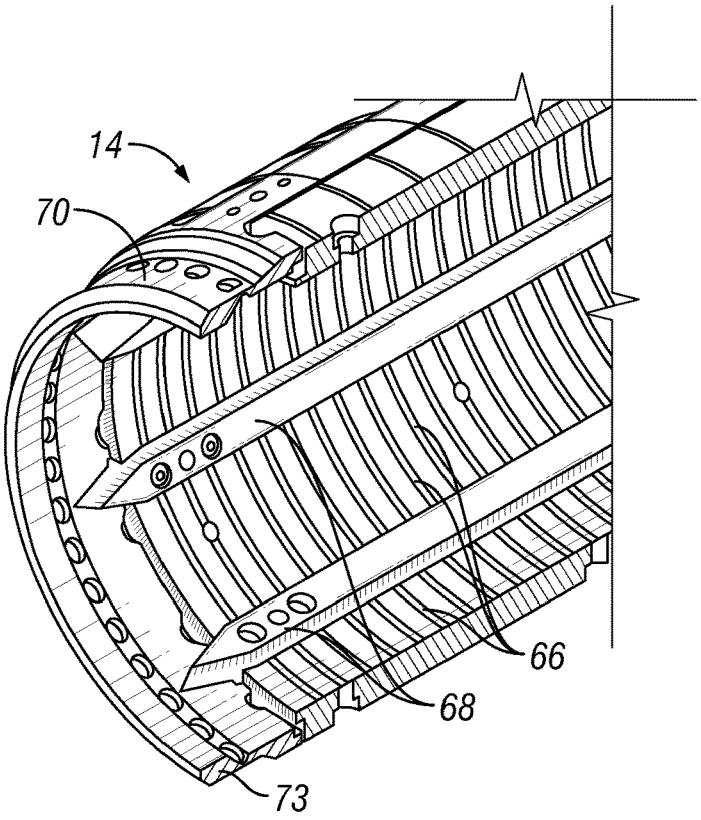

FIGS. 6A and 6B show a longitudinal section of the cage 14 in more detail, seen in perspective view. The cage 14 has a tubular shape with an inner diameter allowing the anchor 28 to be received into the cage 14. For each slip element 50, the cage 14 comprises a respective slip extension member 66 arranged so that when the anchor 28 is received into the cage 14, the slip extension member 66 is located opposite the slip element 50. Each slip extension member 66 is held in place between a pair of axial strips 68 in a manner allowing the slip extension member 66 to move in radial direction and against the inner surface of the casing 6. The cage 14 further comprises upper and lower ring members 70, 72 interconnecting the strips 68. The lower ring member 72 is temporarily connected to the upper end of the tubular element 2 by one or more shear pins (not shown). The upper ring member 70 is provided with an internal upset 73 of inner diameter smaller than the outer diameter of the flange 58 of the central body 40 of the anchor 28. Each strip 68 has a lower end portion tapering in downward direction to promote the anchor 28 to be received into the cage 14.

Normal operation of the system 1 is as follows. The expansion string 16 and the tubular element 2 are simultaneously lowered through the casing 6 and into an open borehole section below the casing, whereby the tubular element 2 is supported on the expander 27. To maintain wellbore control during lowering, drilling fluid may be circulated in the borehole via the fluid channel 42, the bore 36 of the piston, the cylinder 34, and the flow passage 44 of the expander. After lowering to the required depth, whereby the short overlap section 12 of tubular element 2 and casing 6 is present, expansion of the tubular element 2 may be started (FIGS. 1, 5A).

Figure 2:
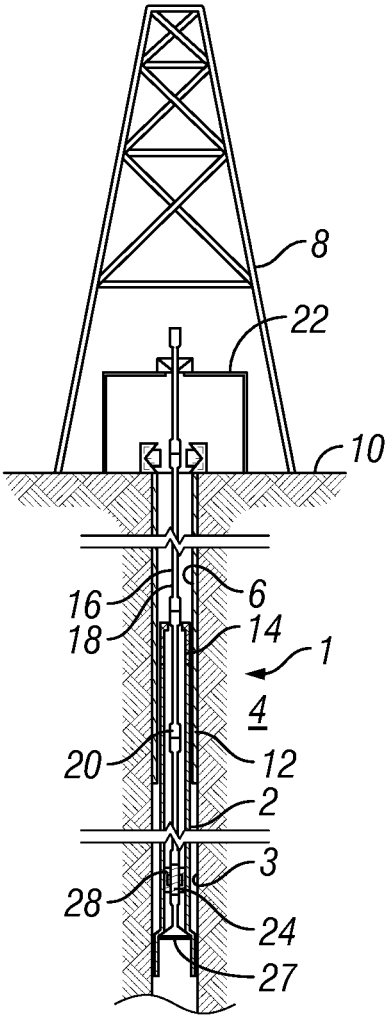
FIG. 2 schematically shows the embodiment after an initial stage of expansion of the tubular element.
Figure 5B:
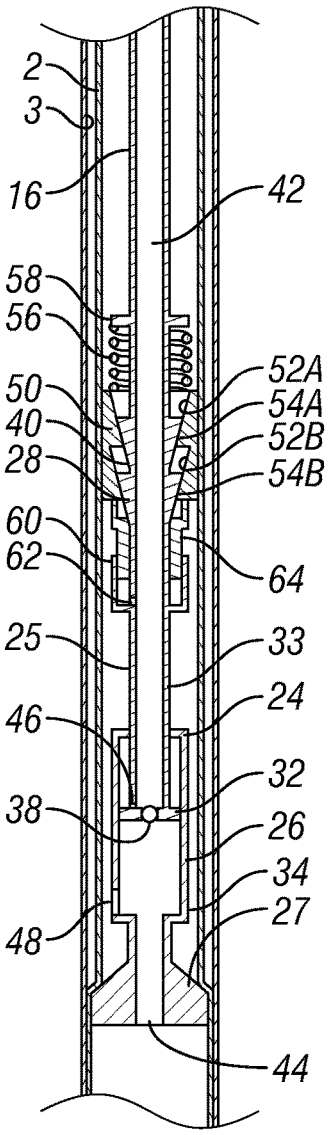
Figure 5E:
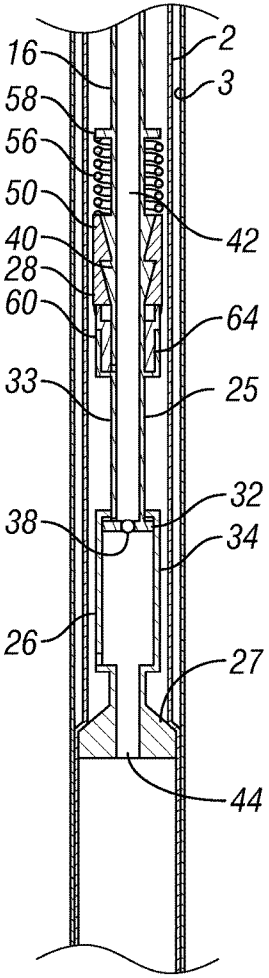
Figure 5D:
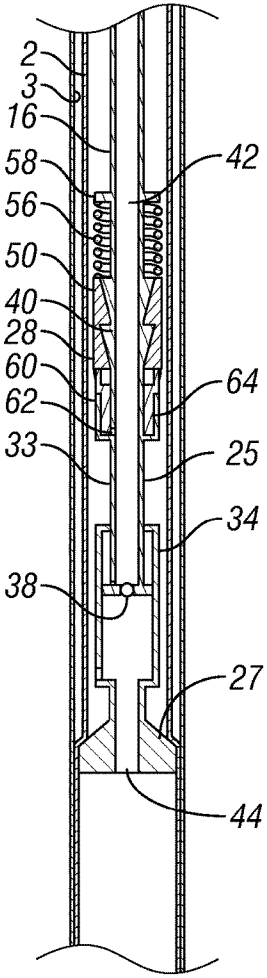
Figure 5C:
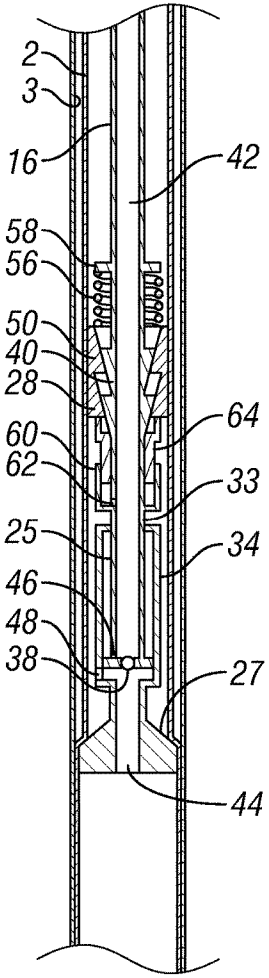

During an initial stage of the expansion process the plug 38 is pumped in a stream of hydraulic fluid through the fluid channel 42 of the expansion string 16 until the plug closes the bore 36 of piston 32. Pumping of hydraulic fluid through the fluid channel 42 is then proceeded so that hydraulic fluid is pumped into the cylinder 34 of the jack device 24 via the side opening 46 of the mandrel 33, and into the hydraulic actuator 60 of the anchor 28 via the side opening 62 of the central body 40. As a result the actuator member 64 pushes the slip elements 50 against the force of spring 56 to the radially expanded mode so that the anchor 28 becomes activated. With the anchor 28 activated, the increased fluid pressure in the cylinder 34 causes the jack device 24 to stroke in whereby the cylinder 34 moves upwardly relative to the mandrel 33 and thereby pulls the expander 27 into the tubular element 2. A lower portion of the tubular element is thereby expanded (FIGS. 2, 5B, 5C).

Figure 3:
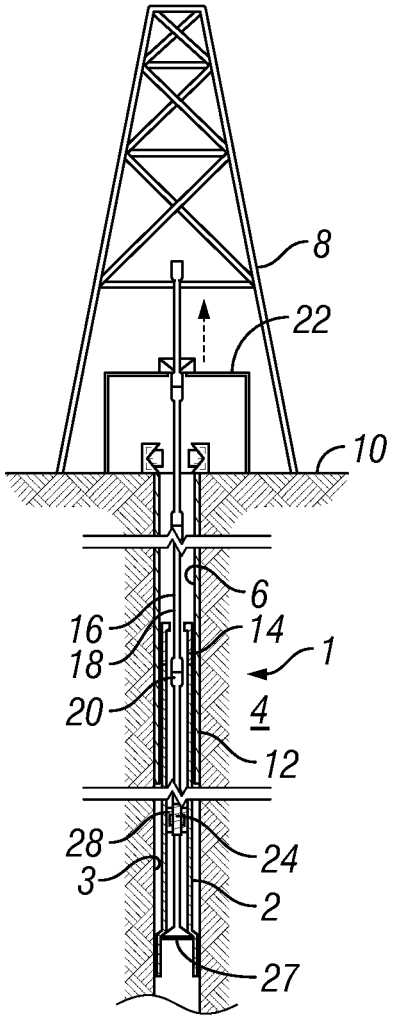
FIG. 3 schematically shows the embodiment after a further stage of expansion of the tubular element.
Figure 4:
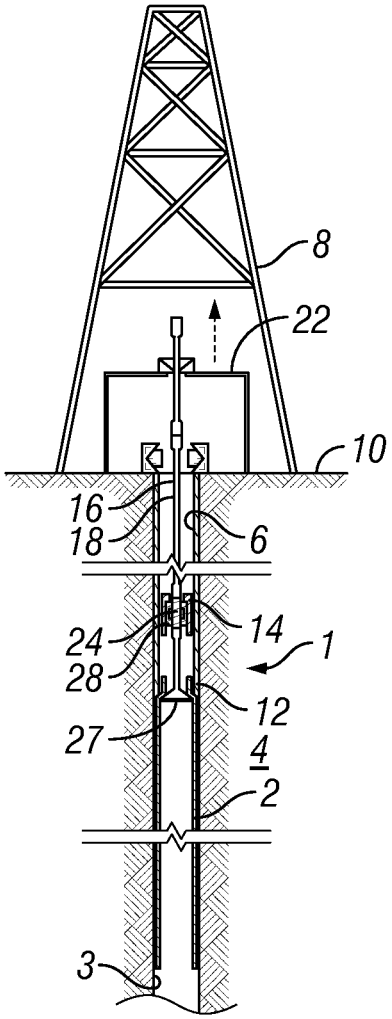
FIG. 4 schematically shows the embodiment during a final stage of expansion of the tubular element.

During a further stage of the expansion process, after the jack device 24 has fully stroked in, the fluid pressure in the fluid channel 42 is released so that, as a result, the compression spring 56 pushes the slip elements 50 to the radially retracted mode. In a next step the expansion string 16 is pulled upwardly in order to fully stroke out the jack device 24 (FIGS. 3, 5D, 5E).

Thus, one cycle of the expansion process includes the steps of activating the anchor 28, stroking the jack device 24 in to radially expand a section of the tubular element 2, deactivating the anchor 28, and pulling the expansion string 16 upwardly. The cycle is repeated as many times as necessary to fully expand the tubular element 2.

As the anchor 28 reaches the top of the tubular element 2, pulling the expansion string 16 further upwardly causes the anchor 28 to enter into the cage 14. The expansion cycle is then repeated whereby during activation of the anchor 28, the slip elements 50 of the anchor push the respective slip extension members 66 against the inner surface of the casing 6. In this manner the anchor 28 is anchored to the casing 6 thereby allowing the jack device 24 to pull the expander 27 through the upper end portion of the tubular element 2. At the end of this expansion cycle the expansion string 16 is pulled upwardly whereby the flange 58 of the anchor moves against the internal upset 73 of the cage 14 so that the shear pin of the cage shears off. Thereafter the cage 14 remains attached to the anchor 28 and moves upwardly with the anchor during the final cycles of the expansion process. Once the tubular element 2 has been fully expanded, the expansion string 16 together with the cage 14 is removed from the borehole 3.

If desired an upward pulling force may be applied to the expansion string 16 during stroking in of the jack device 24 in order to supplement the holding power of the anchor 28. This may be especially useful during expansion of the tubular element in the overlap section 12, when the tubular element 2 and the casing 6 are expanded simultaneously.

The present invention is not limited to the embodiments as described above. Various modifications are conceivable within the scope of the appended claims. Features of respective embodiments for instance may be combined.

We claim:

1. A system for radially expanding a tubular element in a borehole formed in an earth formation, the system comprising:

an expansion string for extending into the tubular element, the expansion string including an expander and a jack device for pulling the expander through the tubular element to radially expand the tubular element;

the jack device being provided with an anchor having at least one slip element adapted to be radially moved against the inner surface of the tubular element; and a cage positioned above the tubular element and being surrounded by a cylindrical wall, the cage being adapted to receive the anchor and to be radially expanded by the anchor against said cylindrical wall.

2. The system of claim 1, wherein the cage comprises, for each slip element, a respective slip extension member arranged to be moved by the slip element in radially outward direction against the cylindrical wall.

3. The system of claim 2, wherein the cage comprises first and second ring members mutually spaced in axial direction, the ring members being interconnected by axially extending strips, and wherein each slip extension member is arranged between a respective pair of adjacent strips.

4. The system of claim 3, wherein each strip has a lower end portion tapering in downward direction.

5. The system of claim 3, wherein each slip element has an upper end portion tapering in upward direction.

6. The system of claim 2, wherein the expansion string includes a mandrel interconnecting the expander and the jack device, and wherein each slip element is rotatable about a central longitudinal axis of the mandrel and relative to the mandrel.

7. The system of claim 2, wherein each slip extension member is locked in a radially inward position and arranged to be unlocked from the radially inward position by radially outward movement of the respective slip element against the slip extension member.

8. The system of claim 7, wherein the slip extension member is locked in the radially inward position by at least one shear pin adapted to be sheared-off by said radially outward movement of the respective slip element against the slip extension member.

9. The system of claim 1, wherein the cage is connected to the upper end of the tubular element and adapted to be disconnected from said upper end by upward movement of the anchor against the cage.

10. The system of claim 9, wherein the cage is connected to the upper end of the tubular element by at least one shear pin adapted to be sheared-off by said upward movement of the anchor against the cage.

11. The system of claim 1, wherein the jack device is a hydraulic jack device arranged to be operated by hydraulic fluid supplied via a fluid channel formed in the expansion string.

12. The system of claim 11, wherein the anchor is arranged to be moved from the radially retracted mode to the radially expanded mode by fluid pressure in the fluid channel.

13. The system of claim 1, wherein said cylindrical wall is one of the borehole wall and the wall of another tubular element extending in the borehole.

14. A method of radially expanding a tubular element in a borehole formed in an earth formation, the method comprising the steps of:

extending an expansion string into the tubular element, the expansion string including an expander and a jack device provided with an anchor, the anchor having at least one slip element adapted to be radially moved against the inner surface of the tubular element;

positioning a cage above the tubular element, the cage being surrounded by a cylindrical wall;

receiving the anchor in the cage and inducing the anchor to radially expand the cage against said cylindrical wall; and pulling the expander through the tubular element using the jack device so as to radially expand the tubular element.

15. The method of claim 14, wherein:

the cage comprises, for each slip element, a respective slip extension member;

the method comprises inducing the slip element to move the slip extension member in a radially outward direction against the cylindrical wall; and the tubular element is expanded to form an expanded liner or casing section in a wellbore for the production of hydrocarbon fluid.

* * * * *